US007301132B2

(12) United States Patent
Kim et al.

(10) Patent No.: US 7,301,132 B2
(45) **Date of Patent: *Nov. 27, 2007**

(54) HEATING APPARATUS USING ELECTROMAGNETIC WAVE

(75) Inventors: Eung Su Kim, Seoul (KR); Jin Yul Hu, Seoul (KR); Sung Hun Sim, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/267,181

(22) Filed: Nov. 7, 2005

(65) Prior Publication Data

US 2007/0039953 A1 Feb. 22, 2007

(30) Foreign Application Priority Data

Aug. 22, 2005 (KR) ..... 10-2005-0076738

(51) Int. Cl.
*H05B 6/76* (2006.01)

(52) U.S. Cl. ..... 219/742; 219/739; 219/743; 174/374; 174/388

(58) Field of Classification Search ..... 219/739–743, 219/756; 174/35 GC, 35 MS, 374, 388
See application file for complete search history.

(56) References Cited

U.S. PATENT DOCUMENTS 4,102,041 A * 7/1978 Copping et al. ..... 219/742
4,166,207 A * 8/1979 Burke ..... 219/741
4,313,044 A * 1/1982 Staats ..... 219/742
4,390,767 A * 6/1983 Bucksbaum et al. ..... 219/740
4,471,194 A * 9/1984 Hosokawa et al. ..... 219/742
5,036,171 A * 7/1991 Kim et al. ..... 219/742

FOREIGN PATENT DOCUMENTS

JP 52-3744 * 1/1977

* cited by examiner

*Primary Examiner*—Philip H. Leung
(74) *Attorney, Agent, or Firm*—Birch, Stewart, Kolasch & Birch, LLP

(57) ABSTRACT

A heating apparatus using an electromagnetic wave is disclosed, by which cut-of performance of an electromagnetic wave is enhanced by increasing an electromagnetic wave absorption bandwidth having cut-off performance below −70 dB. The present invention includes a door provided to an open front side of a body to be opened/closed, a choke filter having a panel type choke part arranged by at least one or more rows along an edge of the door and a filter part arranged by at least one or more rows along the choke and having a plurality of slots wherein a prescribed choke part is provided to a most inner side, a glass panel attached to an inner lateral side of the door and the choke filter, and a flange part provided to an external end portion of the door along the edge of the door to lie in a same level with an inner lateral side of the glass panel.

13 Claims, 5 Drawing Sheets

HEATING APPARATUS USING ELECTROMAGNETIC WAVE

This application claims the benefit of the Korean Patent Application No. P2005-76738, filed on Aug. 22, 2005, which is hereby incorporated by reference as if fully set forth herein.

BACKGROUND OF THE INVENTION

1. Field of the Invention

The present invention relates to a heating apparatus, and more particularly, to a heating apparatus using an electromagnetic wave. Although the present invention is suitable for a wide scope of applications, it is particularly suitable for increasing a capacity of a cavity, enhancing cut-off performance of the electromagnetic wave, and enhancing cleaning facilitation.

2. Discussion of the Related Art

Generally, an electronic oven, a microwave oven and the like are devices for heating food and drink using an electromagnetic wave. And, a heating apparatus using an electromagnetic wave is the general term for theses devices.

A heating apparatus using an electromagnetic wave according to a related art includes a choke filter provided to an edge of a door to prevent the electromagnetic wave from leaking through a gap between an open front side of a body and the door. And, the front side of the body and the choke filter configure an electromagnetic wave cut-off circuit (L-C circuit).

And, the door of the electronic oven is configured to be projected to a prescribed height inward the cavity for thermal insulation of a high temperature state within the cavity. Namely, the door is configured to have a thin edge.

A gasket and a glass panel is provided to the door of the heating apparatus using the electromagnetic wave for airtightness and thermal insulation of the inside of the cavity.

The heating apparatus using the electromagnetic wave heats food and drink in a manner of applying the electromagnetic wave having a frequency of about 2.45 GHz suitable for heating the food and drink well to the inside of the cavity.

However, the related art heating apparatus using the electromagnetic wave has the following problems.

First of all, since the gasket and glass panel are installed at the door of the heating apparatus for the thermal insulation, a gap between the front side of the body and the choke filter is unable to avoid increasing. If the gap increases, capacitance (C) of the electromagnetic wave cut-off performance is reduced so that a graph, as shown in FIG. 1, has a sharp peak to considerably reduce an electromagnetic wave absorption bandwidth having the cut-off performance below about 70 dB. Hence, the electromagnetic wave cut-off performance is considerably lowered.

As the gap between the front side and the choke filter increases, the electromagnetic wave absorption bandwidth sensitively varies in a direction of being narrowed. For instance, if a gap between the front side of the body and a coil, as shown in FIG. 1, is 1 mm (G1), the electromagnetic wave absorption bandwidth is about 100 MHz. If the gap between the front side of the body and the coil, as shown in FIG. 1, is 3 mm (G2), the electromagnetic wave absorption bandwidth is about 50 MHz. If the gap between the front side of the body and the coil, as shown in FIG. 1, is 10 mm (G3), there exists almost no electromagnetic wave absorption bandwidth. Yet, in case that the gasket and the glass panel are installed at the door of the heating apparatus, a substantial gap between the front side of the door and the choke filter is about 6~7 mm, it can be seen that the electromagnetic wave cut-off performance is considerably reduced.

Secondly, the cavity has the EMI (electromagnetic interference) characteristic since the electromagnetic wave interference or electromagnetic interference (EMI) is generated by a harmonic frequency due to the interference of the frequency of 2.45 GHz. As the electromagnetic wave bandwidth is reduced, it becomes difficult to eliminate the harmonic frequency.

Thirdly, the volume (size) of the cavity attempts to be increased in a manner of reducing a wall thickness of the body to increase a capacity of the electronic or microwave oven. Once the thickness of the front side of the body is decreased, an area of the front side of the body is decreased so that the capacitance (C) is considerably reduced to decrease the electromagnetic wave cut-off circuit considerably. Thus, limitation is put on reducing the wall thickness of the body.

SUMMARY OF THE INVENTION

Accordingly, the present invention is directed to a heating apparatus using an electromagnetic wave that substantially obviates one or more problems due to limitations and disadvantages of the related art.

An object of the present invention is to provide a heating apparatus using an electromagnetic wave, by which cut-off performance of an electromagnetic wave is enhanced by increasing an electromagnetic wave absorption bandwidth having cut-off performance below −70 dB.

Another object of the present invention is to provide a heating apparatus using an electromagnetic wave, by which cut-off performance of a harmonic frequency generated from interference of the electromagnetic wave can be enhanced.

Another object of the present invention is to provide a heating apparatus using an electromagnetic wave, electromagnetic wave cut-off performance is not almost affected by an increased gap between a front side of a body and a choke filter.

Another object of the present invention is to provide a heating apparatus using an electromagnetic wave, by which electromagnetic wave cut-off performance can be secured even if a front side thickness of a body is reduced.

A further object of the present invention is to provide a heating apparatus using an electromagnetic wave, by which cut-off performance of a door and an EMI characteristic are enhanced in a manner of reducing a gap between a front side of a body and a choke filter to increase an approximation effect.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a heating apparatus using an electromagnetic wave according to the present invention includes a door provided to an open front side of a body to be opened/closed, a choke filter having a panel type choke part arranged by at least one or more rows each along an edge of the door and a filter part by at least one or more rows along the choke and having a plurality of slots, wherein a prescribed choke part is provided to a most inner side, a glass panel attached to an inner lateral side of the door and the choke filter, and a flange part provided to an external end portion of the door along the edge of the door to lie in a same level with an inner lateral side of the glass panel.

Preferably, the flange part is bent toward a central portion of the door to lie in the same level of the inner lateral side of the glass panel.

Preferably, a gasket is provided between the flange part and an edge of the glass panel to seal a gap between the door and the front side of the body.

Preferably, the choke part is bent toward the external end portion of the door.

Preferably, the filter part is bent toward the external end portion of the door.

In another aspect of the present invention, a heating apparatus using an electromagnetic wave includes a door provided to an open front side of a body, a choke filter including a panel type choke part arranged by at least one or more rows along an edge of the door, the choke part bent toward an external end portion of the door, a filter part having a plurality of slots, the filter part bent toward the external end portion of the door wherein a prescribed choke part is arranged on a most inner side, a glass panel attached to an inner lateral side of the door and the choke filter, and a flange part provided to the external end portion of the door along the edge of the door to lie in a same level with the inner lateral side of the glass panel, the flange part bent toward a central portion of the door.

Preferably, the heating apparatus further includes a gasket provided between the flange part and an edge of the glass panel to seal a gap between the door and the front side of the body.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
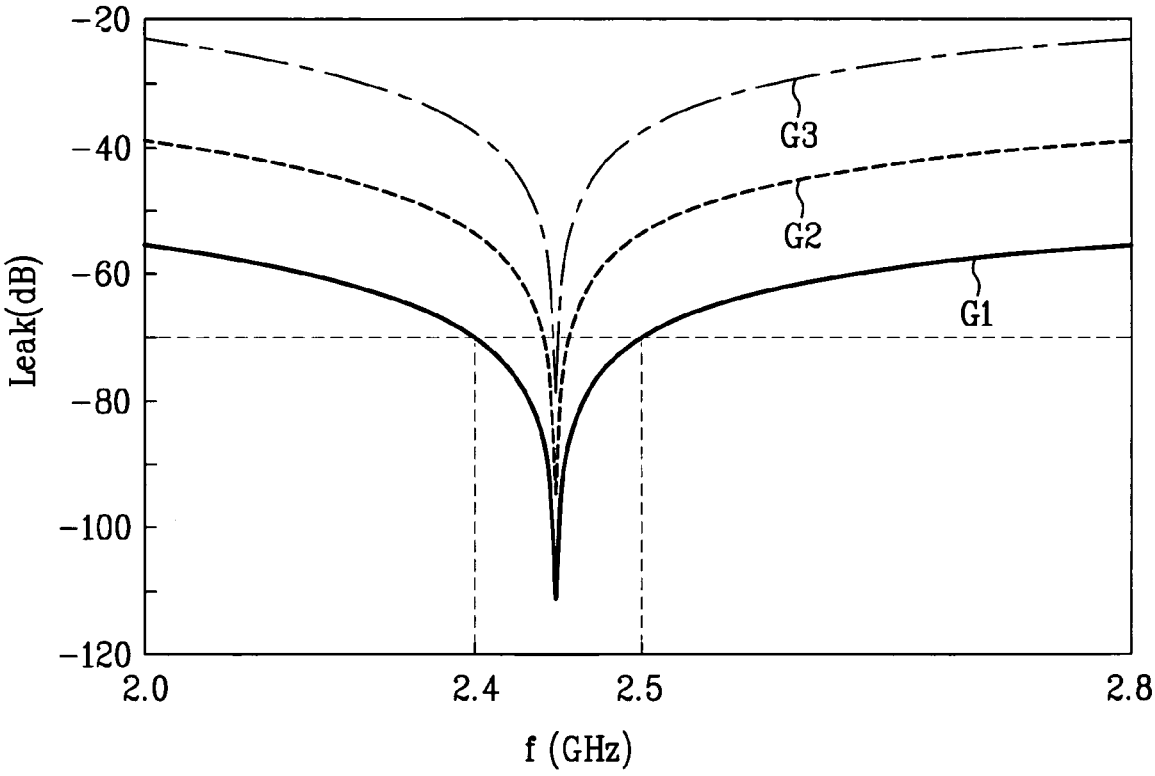
FIG. 1 Related Art
FIG. 1 is a graph of electromagnetic wave cut-off performance of a heating apparatus using an electromagnetic wave according to a related art.
Figure 2:
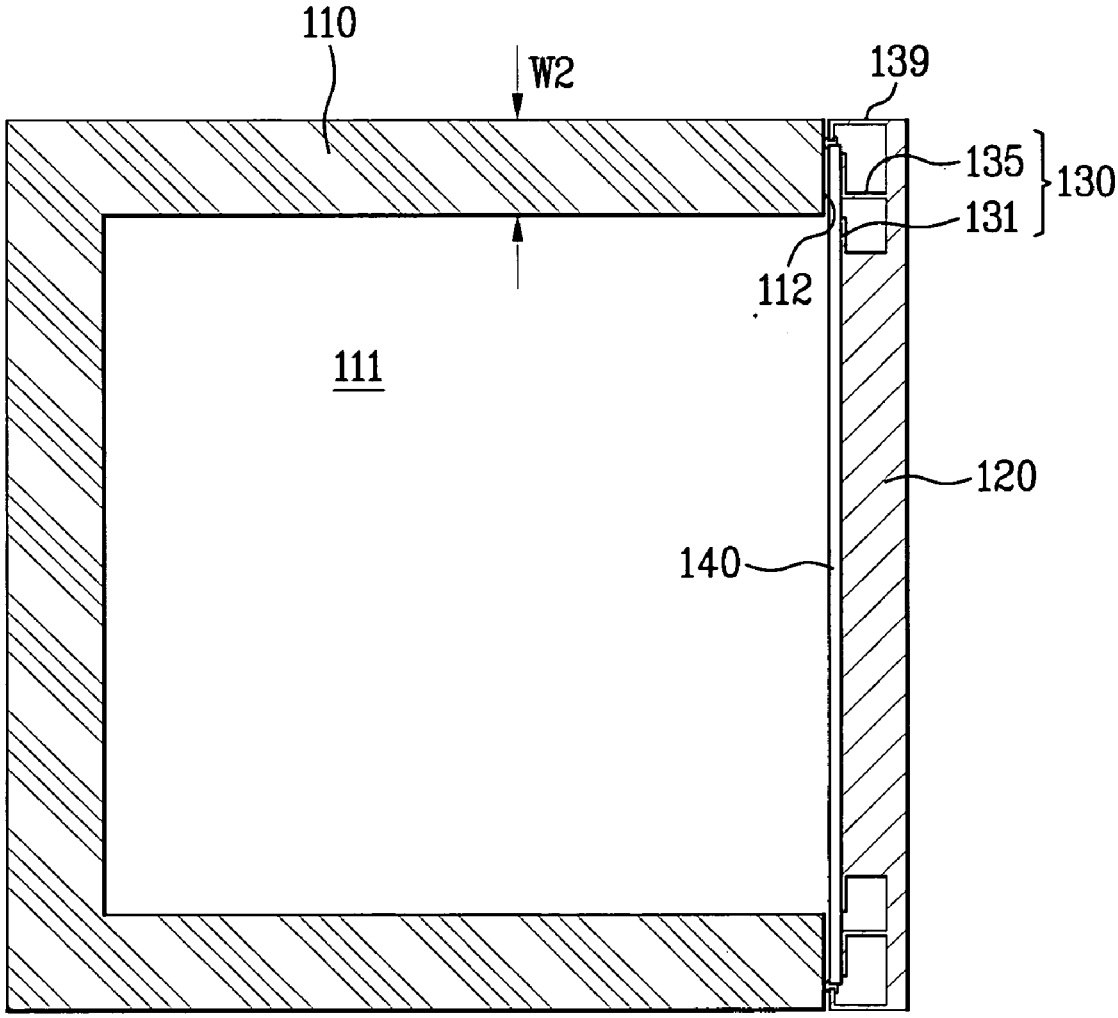
FIG. 2 is a cross-sectional diagram of a heating apparatus using an electromagnetic wave according to an embodiment of the present invention.
Figure 3:
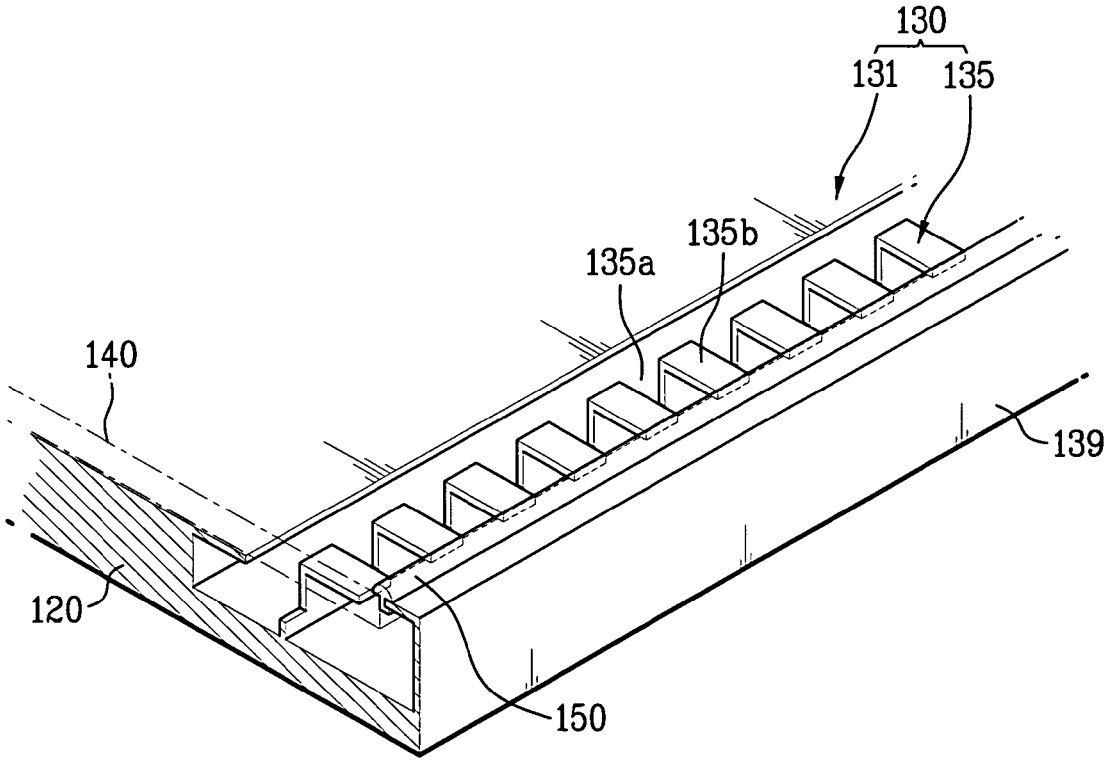
FIG. 3 is a perspective diagram of a choke filter in FIG. 2.

FIG. 2 is a cross-sectional diagram of a heating apparatus using an electromagnetic wave according to a first embodiment of the present invention, and FIG. 3 is a perspective diagram of a choke filter in FIG. 2.

Referring to FIG. 2 and FIG. 3, a heating apparatus using an electromagnetic wave according to a first embodiment of the present invention includes a door 120 provided to an open front side 112 of a body 110 to be opened/closed, a choke filter 130 having a panel type choke part 131 arranged by at least one or more rows along an edge of the door 120 and a filter part 135 by at least one or more rows and having a plurality of slots 135*b* wherein a prescribed choke part 131 is provided to a most inner side among the choke and filter parts, a glass panel 140 attached to an inner lateral side of the door 120 and the choke filter 130, and a flange part 139 provided to an external end portion of the door 120 along the edge of the door to lie in a same level with an inner lateral side of the glass panel 140.

A cavity 111 is provided within the body 110 to accommodate food and drink. In this case, a wall side of the body 110 and the front side 112 of the body 112 are formed of a conductor.

The above-configured front side 112 of the body 110 and the choke filter 130 configure an electromagnetic wave cut-off circuit that will be explained later.

The choke filter, as shown in FIG. 3, includes the choke part 131 and the filter part 132. FIG. 2 exemplary shows the choke and filter parts arranged by one row each. Hence, as long as the prescribed choke part 131 is arranged at the most inner side, at least two rows of the filter parts or at least one row of the filter and choke parts can be arranged outside the most inner choke part 131.

In this case, since the choke part 131 is configured to have a panel shape, an electromagnetic wave can be cut off by setting impedance Z to infinity (∞). Namely, if 'current (i)=0' and 'voltage (V)=constant' at a tip of the choke part, the impedance Z diverges to infinity to cut of the electromagnetic wave of a prescribed frequency.

If the choke part 131 is arranged to confront the front side of the body or if a portion of the choke part 131 is arranged not to confront the front side of the body, an operational characteristic of the choke part 131 is insensitive. Hence, even if the choke part 131 is arranged not to confront the front side 112 of the body 110, the impedance Z shows almost no variation. Hence, even if the portion of the choke part 131 is arranged not to oppose the front side 112 of the body 110 (thickening a width of the choke coil to be thicker than the wall side) by decreasing a thickness W of a left/right/top/bottom wall side, the almost same impedance can be obtained.

The filter part 135, which includes a plurality of slots 135*a* and ribs 135*b*, configures an L-C circuit to cut off the electromagnetic wave. If the filter part 135 including a plurality of the slots 135*b* fails in confronting the front side 112 of the body 110 in part, the operational characteristic of the filter part 135 sensitively varies. Hence, the filter part 135 needs to be arranged to confront the front side 112 of the body to have sufficient cut-off performance.

In case that the choke part 131, as shown in FIG. 2 and FIG. 3, is arranged at the most inner side, the portion of the choke part 131 is arranged not to confront the front side 112 of the body 110. Hence, a width of the choke filter 130 can be increased and the wall side of the body can be relatively thinned.

The choke filter is explained in detail with reference to FIG. 3 as follows. In the following description, it is assumed that the choke part 131 and the filter part 135 are arranged by one row each.

In the choke filter 130, the choke part 131 is arranged at a most inner side and the filter part 135 is arranged outside the most inner choke part. And, the flange part 139 is arranged outside the filter part 135.

In this case, the most inner choke part 131 is preferably bent to confront an external end portion of the door 120. This is to prevent the operational characteristic of the choke part from being degraded in a manner that an operational space provided beneath the most inner choke part opposes the front side of the body.

And, it is preferable that the filter part 135 is bent to confront the external end portion of the door 120. This is to independently configure an L-C circuit in the choke and filter parts in a manner of partitioning the operational space of the choke part from the operational space of the filter part. If a tip of the filter part faces a central portion of the door, the operational spaces merge together. Hence, it is unable to independently configure the L-C circuit in the choke and filter parts.

And, the flange part 139 is bent toward a central part of the door. Theses choke, filter and flange parts 131, 135 and 139 are approximately bent to have a '¬' shape.

It is preferable that the slits 135*b* of the filter part 135 are arranged to be spaced apart from each other by a same interval. Yet, it can be understood that the slits 135*b* of the filter part 135 may be arranged to leave an uneven interval in-between.

Preferably, the flange part 139 is bent to lie in the same level with the inner lateral side of the glass panel 140. This is to enhance cleaning facilitation in a manner that the inner lateral side of the glass panel 140 lies in the same plane of the flange part 130 by attaching the glass panel 140 to the inner lateral side of the door 120. Moreover, by leaving the front side of the body in the vicinity of the flange part to be almost attached to the flange part, it is more advantageous for the electromagnetic wave cut-off and the air-tightness of the cavity.

Preferably, a gasket is further provided between the flange part 139 and an edge of the glass panel 140. The gasket seals a gap between the glass panel 140 and the door 120.

An operation of the heating apparatus according to the present invention is explained with reference to FIG. 4 and FIG. 5 as follows.

Figure 4:
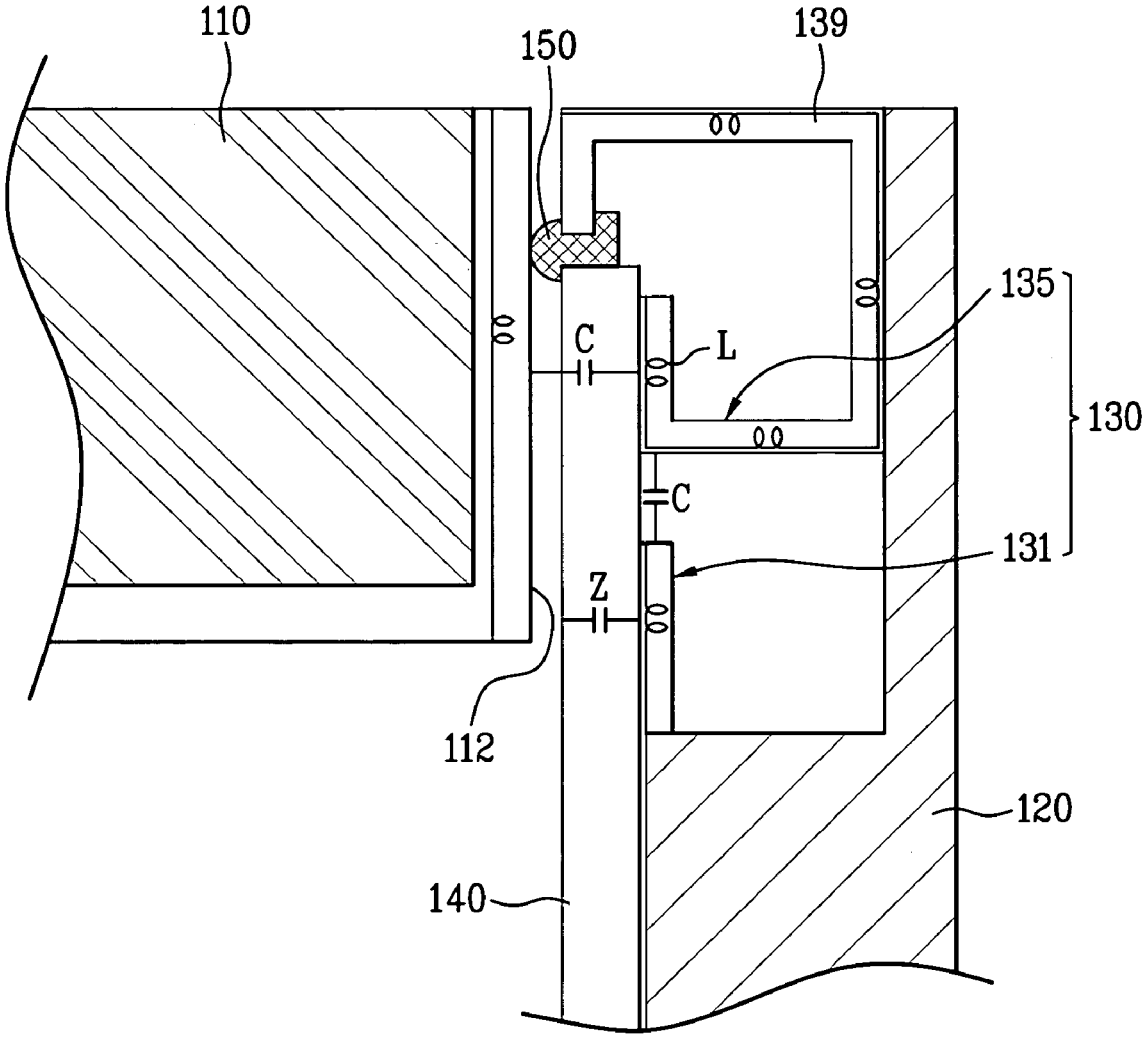
FIG. 4 is a magnified cross-sectional diagram for explaining an action of an electromagnetic wave cut-off circuit of the heating apparatus shown in FIG. 2.
Figure 5:
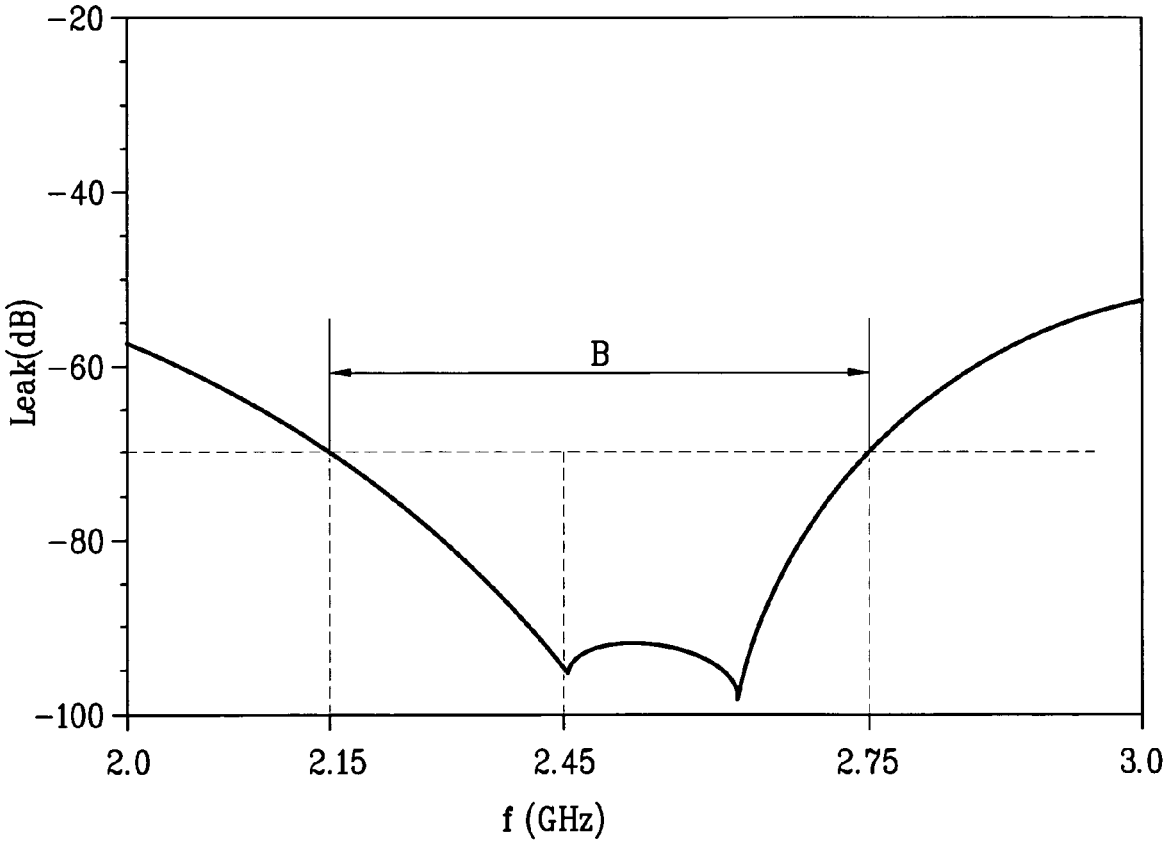
FIG. 5 is a graph of electromagnetic wave cut-off performance of the heating apparatus shown in FIG. 2.

Referring to FIG. 4 and FIG. 5, an electromagnetic wave of about 2.45 GHz is applied to an inside of the cavity 111 of the heating apparatus. The applied electromagnetic wave is reflected by the conductive cavity 111, a stirrer fan (not shown in the drawing) and the like in all directions to heat the food and drink.

In doing so, by setting the impedance Z to infinity (∞) in the choke part 131, the leaking electromagnetic wave is primarily cut off. Subsequently, the L-C circuit is configured in the filter part 135 to secondarily cut off the leaking electromagnetic wave. For instance, as shown in FIG. 4, a value 'L' is formed on the open front side 112 of the body and a surface of the filter part 135. Simultaneously, a value 'C' is formed in the space between the front side 112 of the body and the filter part 135, in the inner space of the filter part 135 and in the slots 135*a* of the filter part 135. Namely, the value 'L' is formed on the surface, while the value 'C' is formed in the gap between the structures and in the corresponding space. Hence, the infinitive impedance Z and the L-C circuit (i.e., dual cut-off circuit) are configured in the body 110 and the choke coil 130 to considerably enhance the electromagnetic wave cut-off performance.

FIG. 5 is a graph of electromagnetic wave cut-off performance of the heating apparatus shown in FIG. 2, in which a gap between the front side 112 of the body 110 and the choke filter 130 is set to 7 mm and for which the choke filter 130 having the choke part 131 and the filter part 135 are used.

The choke filter 130 substantially configures the dual cut-off circuit with the impedance Z and the L-C circuit. Due to the dual cut-off circuit, a leakage in the bandwidth B between 2.15~2.75 GHz amounts to −70 dB or below. Namely, the electromagnetic wave absorption bandwidth B having the leakage of −70 dB is considerably increased higher than that of the related art. In this case, 'dB=10 log(output value/input value)', the input value is a value of the electromagnetic wave applied to the inside of the cavity, and the output value indicates a leakage value of the electromagnetic wave.

Hence, since the bandwidth B of 2.15~2.75 GHz shows a leakage amount below −70 dB, it can be seen that the electromagnetic wave cut-off performance is considerably raised. Specifically, since the electromagnetic wave of 2.45 GHz applied to a general electronic or microwave oven belongs to the above-explained electromagnetic wave absorption bandwidth B, it is able to considerably prevent the electromagnetic wave from leaking through the gap of the door 120.

And, as the electromagnetic wave absorption bandwidth B is considerably raised, the cut-off performance for the harmonic frequency is considerably enhanced.

Thus, as the electromagnetic wave cut-off performance is considerably enhanced, it is able to sufficiently secure the electromagnetic wave cut-off performance even if the width of the top/bottom/left/right wall of the body is set smaller than that of the related art.

Accordingly, the present invention provides the following effects or advantages.

First of all, although the capacitance (C) is reduced according to the increased gap between the front side of the body and the choke filter, the heating apparatus according to the present invention employs the choke filter having the choke part and the filter part, thereby cutting off the electromagnetic wave doubly.

Hence, as the electromagnetic wave absorption bandwidth having the cut-off performance below about 70 dB is considerably raised, the cut-off performance of the electromagnetic wave is enhanced.

Secondly, since the choke part is located at the most inner side, it is able to prevent the electromagnetic wave absorption bandwidth from being sensitively varied even if the thickness of the wall of the body is decreased.

And, by arranging the choke part to oppose the cavity of the body, it is able to secure the electromagnetic wave cut-off performance and to considerably reduce the thickness of the wall of the body.

Moreover, the electromagnetic wave absorption bandwidth is more increased, whereby the electromagnetic wave cut-off performance and the EMI (electromagnetic interference) characteristic become more enhanced.

Thirdly, since the thickness of the wall of the body is reduced, it is able to increase the capacity of the cavity of which inside is extended.

Fourthly, since the flange part and the glass panel lie in the same plane, the flange part and the front side of the body are almost attached to each other when the door is closed. Hence, it is able to facilitate the cavity to be cut off.

Finally, since the most outer filter part is bent inward, the most outer filter part and the glass panel are smoothly connected to facilitate cleaning.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A heating apparatus using an electromagnetic wave, comprising:

a body forming a cavity for accommodating foods;

a door provided to an open front side of the body;

a choke filter including a choke part arranged by at least one row each along an edge of the door and a filter part arranged by at least one row each along the choke part, the filter part comprising a plurality of ribs and slots formed between two adjacent ribs;

a glass panel provided to an inner lateral side of the door, and covering upper sides the choke part and at least a partial portion of the filter part; and a flange part provided to an external end portion of the door along the edge of the door, wherein an end portion of the flange part is bent toward a central portion of the door and a top surface of the end portion of the flange part facing the body and a surface of the glass facing the body are coplanar.

2. The heating apparatus of claim 1, wherein the flange part is bent toward a central portion of the door.

3. The heating apparatus of claim 1, wherein a top surface of the ribs and the top surface of the flange part are non-coplanar.

4. The heating apparatus of claim 1, further comprising a gasket provided between the flange part and an edge of the glass panel for sealing a gap between the door and the front side of the body.

5. The heating apparatus of claim 1, wherein the choke part positioned at the most inner side of the choke filter is bent toward the outer edge of the door.

6. The heating apparatus of claim 1, wherein the filter part is bent toward the outer edge of the door.

7. The heating apparatus of claim 1, wherein each of the two adjacent ribs has a base portion of the rib and a tip of the rib extending from the base portion toward an outer edge of the door with partitioning an operational space of the choke part from an operational space of the filter part.

8. The heating apparatus of claim 1, wherein the choke part has a panel shape.

9. A heating apparatus using an electromagnetic wave, comprising:

a body forming a cavity for accommodating foods;

a door provided to an open front side of the body;

a choke filter including a choke part arranged by at least one row each along an edge of the door and a filter part arranged by at least one row each along the choke part;

a glass panel provided to an inner lateral side of the door, and covering the choke part and at least a partial portion of the filter part; and a flange part provided to an external end portion of the door along the edge of the door, and having a top surface on a same plane with a surface of the glass facing the body, wherein absorption of the electromagnetic wave by the choke part has a maximum at a first frequency, absorption of the electromagnetic wave by the filter part has a maximum at a second frequency, and a centre frequency of the electromagnetic wave is outside of a range between the first frequency and the second frequency in order to increase the electromagnetic wave absorption bandwidth.

10. The heating apparatus of claim 9, wherein the first frequency and the second frequency are above the centre frequency.

11. The heating apparatus of claim 9, wherein the first frequency is greater than the second frequency.

12. The heating apparatus of claim 9, wherein the first frequency is smaller than the second frequency.

13. The heating apparatus of claim 9, wherein the centre frequency is 2.45 GHz.

* * * * *